US012090360B2

(12) United States Patent
Von Hagen et al.

(10) Patent No.: US 12,090,360 B2
(45) Date of Patent: Sep. 17, 2024

(54) WEARABLE RESISTANCE APPARATUS

(71) Applicants: Dalton Harold Von Hagen, Toronto (CA); Hayden Michael Lowes, Regina (CA)

(72) Inventors: Dalton Harold Von Hagen, Toronto (CA); Hayden Michael Lowes, Regina (CA)

( * ) Notice: Subject to any disclaimer, the term of this patent is extended or adjusted under 35 U.S.C. 154(b) by 0 days.

(21) Appl. No.: 17/691,466

(22) Filed: Mar. 10, 2022

(65) Prior Publication Data

US 2022/0296957 A1 Sep. 22, 2022

Related U.S. Application Data

(60) Provisional application No. 63/164,192, filed on Mar. 22, 2021.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/035*** | (2006.01) |

(52) U.S. Cl.

CPC .... *A63B 21/4025* (2015.10); *A63B 21/00043* (2013.01); *A63B 21/00061* (2013.01); *A63B 21/04* (2013.01); *A63B 21/0407* (2013.01); *A63B 21/0442* (2013.01); *A63B 21/0552* (2013.01); *A63B 21/4009* (2015.10); *A63B 21/4015* (2015.10); *A63B 21/4043* (2015.10); *A63B 23/03541* (2013.01)

(58) Field of Classification Search

CPC ..... A63B 21/4025; A63B 21/00185; A63B 21/4009; A63B 21/00043; A63B 21/4015; A63B 21/0442; A63B 21/4043; A63B 21/0023; A63B 21/0552; A63B 21/0407; A63B 21/0557; A63B 21/065; A63B 21/4001; A63B 21/4013; A63B 21/4011; A63B 21/4039; A63B 23/04; A63B 23/0405; A63B 21/00178; A63B 21/04; A63B 21/055; A63B 21/0555; A63B 23/0494; A63B 2023/0411; A63B 21/00061

See application file for complete search history.

(56) References Cited

U.S. PATENT DOCUMENTS 5,203,754 A * 4/1993 Maclean ..... A63B 21/4015 482/121

6,179,760 B1 * 1/2001 Rumbaugh ..... A41D 31/18 482/121

(Continued)

*Primary Examiner* — Megan Anderson

(74) *Attorney, Agent, or Firm* — CAPEHART LAW FIRM

(57) ABSTRACT

A wearable resistance apparatus includes a waist band and a pair of leg resistance assemblies. Each leg resistance assembly includes a leg anchor, a foot anchor and at least one resistance band. The resistance bands preferably attach between a waist area and a foot area of a wearer and each extend down a rear of the wearer's legs. When the resistance bands are moved into a resistant position, tension is created in lower body muscles of the wearer, such as gluteal muscles, hamstring muscles and/or calf muscles. The wearable resistance apparatus provides exercise to the wearer during everyday activities and also provides enhanced exercise when performing activities such as walking, cycling, jogging and running.

16 Claims, 7 Drawing Sheets

(56) References Cited

U.S. PATENT DOCUMENTS

| | | | | |
|---|---|---|---|---|
| 7,628,742 | B2 * | 12/2009 | Weaver | A63B 21/4025 482/125 |
| 9,498,691 | B2 * | 11/2016 | Antoine | A63B 21/4025 |
| 9,764,180 | B2 * | 9/2017 | Bybee | A63B 21/0442 |
| 10,245,459 | B1 * | 4/2019 | Cranke | A63B 21/00061 |
| 2001/0007845 | A1 * | 7/2001 | Afanasenko | A63B 21/4009 482/121 |
| 2007/0135279 | A1 * | 6/2007 | Purdy | A63B 21/4025 482/121 |
| 2008/0287840 | A1 * | 11/2008 | Koscielny | A63B 21/4025 601/23 |
| 2012/0202658 | A1 * | 8/2012 | Menefee, Sr. | A63B 21/4005 482/124 |
| 2019/0343670 | A1 * | 11/2019 | Ruprecht | A61H 1/0274 |
| 2021/0401610 | A1 * | 12/2021 | Cainzos Perez | A61F 5/0102 |
| 2022/0008776 | A1 * | 1/2022 | Cho | B25J 11/00 |

* cited by examiner

WEARABLE RESISTANCE APPARATUS

CROSS-REFERENCE TO RELATED APPLICATION

The present application is related to and claims priority to U.S. Provisional Patent Application No. 63/164,192 filed Mar. 22, 2021, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of exercise apparatus of existing art and more specifically relates to a wearable apparatus for exercising a lower body of a wearer.

RELATED ART

One problem many people face is the ability to exercise daily. Time, money, and energy are all factors that discourage most people from daily exercise, particularly if they have a busy lifestyle. Further, the ability to workout is especially impeded in times of epidemics and pandemics, such as the COVID-19 pandemic which saw many gyms across the world being temporarily closed. However, the long term benefits associated with exercise are well known. For example, improved mental health, muscle growth, cardiovascular strengthening, etc. As such, there is a need for an apparatus which provides exercise without taking extra time out of a busy individual's day, allows for enhancement of an individual's regular workout and can be used anywhere.

SUMMARY OF THE INVENTION

In view of the foregoing disadvantages inherent in the known exercise equipment art, the present disclosure provides a novel wearable resistance apparatus. The general purpose of the present disclosure, which will be described subsequently in greater detail, is to provide an exercise apparatus that, when worn, is used to provide resistance to a lower body of a wearer, thus providing exercise during everyday activities and providing enhanced exercise when performing activities such as walking, cycling, jogging and running.

A wearable resistance apparatus is disclosed herein. The wearable resistance apparatus includes a waist band and a pair of leg resistance assemblies. The waist band may be configured to encircle a waist area of a wearer and may include a pair of first band fasteners. The pair of leg resistance assemblies may each be configured for wear about a respective leg of the wearer. Each leg resistance assembly may include a leg anchor, a foot anchor and at least one resistance band.

The leg anchor may be configured to attach about a knee area of the wearer and may include a second band fastener. The foot anchor may be configured to attach about a foot area of the wearer and may include a third band fastener. The at least one resistance band may include a first end opposite a second end and a band length therebetween. The first end may be configured to attach to one of the first band fasteners and the second end may be configured to attach about the third band fastener such that a substantially mid-section of the band length rests about the second band fastener. Thereby, the at least one resistance band may be secured against the respective leg between the waist area and the foot area of the wearer. The at least one resistance band may be in a neutral position when the wearer is seated, and leg movement may move the at least one resistance band into a resistant position, thereby creating tension in at least one muscle between the waist area and the foot area of the wearer (of each leg).

According to another embodiment, a method of using a wearable resistance apparatus is also disclosed herein. The method includes providing the wearable resistance apparatus as above; attaching the first end of the at least one resistance band of each leg resistance assembly to the pair of first band fasteners; threading the second end of the at least one resistance band of each leg resistance assembly through the second band fastener such that substantially the mid-section of the band length rests about the second band fastener; attaching the second end of the at least one resistance band of each leg resistance assembly about the third band fastener; attaching the waist band to the wearer such that the waist band encircles a waist area of the wearer; attaching the leg anchor of each leg resistance assembly to each knee area of the wearer; attaching the foot anchor of each leg resistance assembly to each foot area of the wearer; and selectively moving each leg of the wearer, thereby moving the at least one resistance band of each respective leg resistance assembly into the resistant position and creating tension in at least one muscle between the waist area and the foot area of each leg.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a wearable resistance apparatus, constructed and operative according to the teachings of the present disclosure.

The various embodiments of the present invention will hereinafter be described in conjunction with the appended drawings, wherein like designations denote like elements.

DETAILED DESCRIPTION

Figure 1:
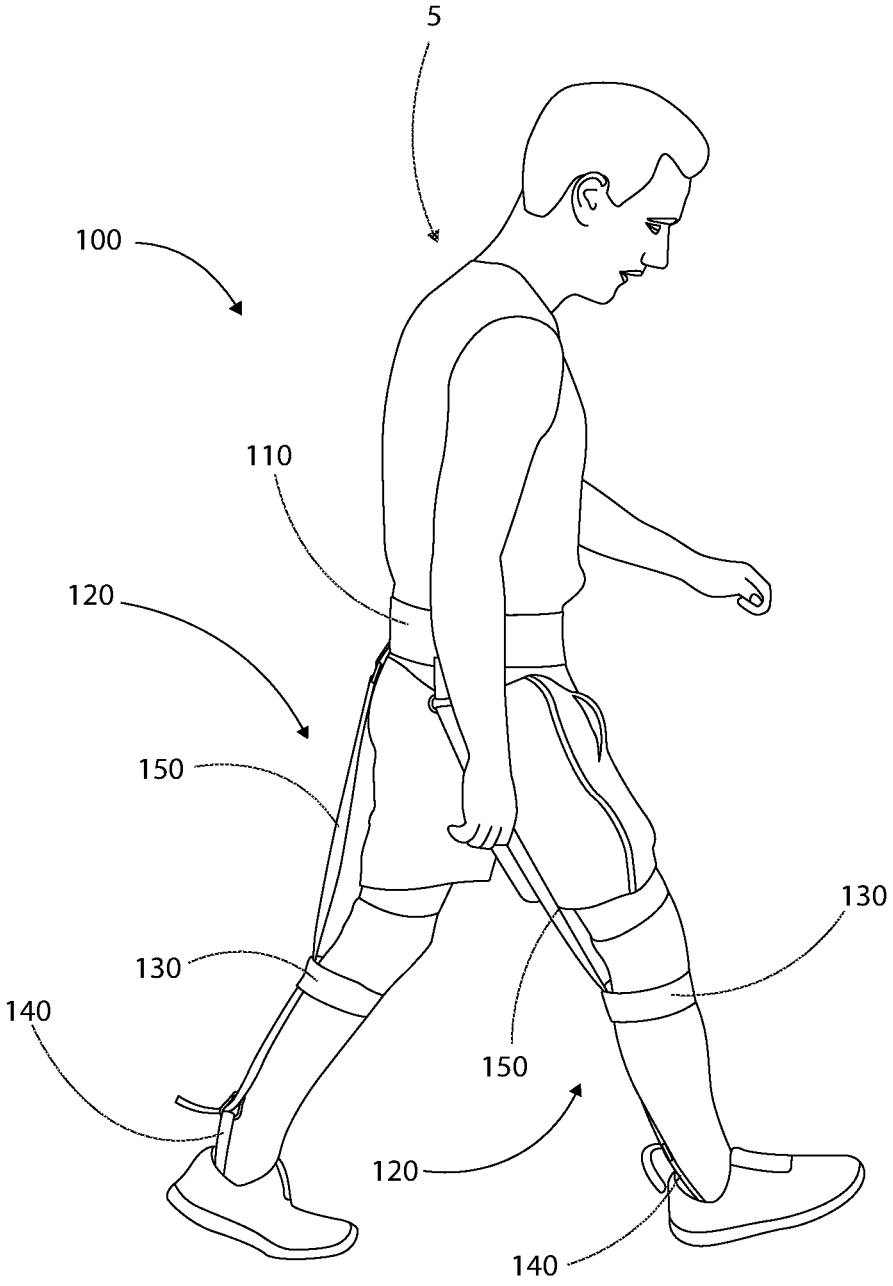
FIG. 1 is a perspective view of the wearable resistance apparatus being used to exercise a lower body of a wearer, according to an embodiment of the disclosure.

As discussed above, embodiments of the present disclosure relate to exercise apparatus and more particularly to a wearable resistance apparatus to provide exercise to a wearer. Generally, the wearable resistance apparatus may be worn discretely underneath pants or above pants, with as little discomfort as possible. The wearable resistance apparatus may be quickly and easily attached to and removed from the wearer. The wearable resistance apparatus may utilize natural leg movements of the wearer to provide a consistent workout with minimal effort. For example, an individual who spends a majority of their day sitting (such as an office worker) may achieve a workout by simply wearing the wearable resistance apparatus and moving their legs between extension and flexion. Alternatively, those who exercise regularly may wear the wearable resistance apparatus to improve their existing workout and add resistance to their routine. For example, runners may achieve better results by wearing the wearable resistance apparatus whilst running.

The wearable resistance apparatus may utilize two resistance bands that begin at the wearer's lower back and run along the back of their legs to their ankle (one resistance band on each leg). When the wearer moves their leg, such as when walking, running, cycling, or simply lifting the leg, the wearable resistance apparatus creates a lower body workout. In some embodiments, the wearable resistance apparatus may further include a waist band; a pair of under knee anchors each having a loop in which one of the resistance bands passes through; and a pair of foot anchors to help control upward pull of the resistance bands.

Referring now more specifically to the drawings by numerals of reference, there is shown in FIGS. 1-6, various views of a wearable resistance apparatus 100. As shown, the wearable resistance apparatus 100 may be worn on a body of the wearer 5, particularly, a lower body of the wearer 5, and as such, the wearable resistance apparatus 100 may provide exercise to the lower body of the wearer 5. As shown in FIGS. 1-6, the wearable resistance apparatus 100 may include a waist band 110 and a pair of leg resistance assemblies 120 each including a leg anchor 130, a foot anchor 140 and at least one resistance band 150.

As shown in FIG. 1 and FIGS. 4-6, the waist band 110 may be configured to encircle a waist area of the wearer 5. It should be appreciated however that the waist band 110 (despite use of the word 'waist') is not limited to positioning at the waist area of the wearer 5. For example, the waist band 110 may encircle a hip area of the wearer 5. The location may be decided by the wearer 5, depending on comfort, area to be exercised, etc. In some embodiments, the waist band 110 may be a continuous loop. In other embodiments, the waist band 110 may include a strip of material with fasteners at either end for attaching about the waist area of the wearer 5. For example, the fasteners may include hook and loop fastener. In some embodiments, the waist band 110 may be a belt-like band. The waist band 110 may be made from a material having a strength ranging from medium to heavy and may be used to provide support to the leg anchor 130, as well as provide overall support to the wearer 5. In some embodiments, the waist band 110 may be resistant to flexing. Further, preferably, the waist band 110 may include be adjustable, providing for differently sized wearers and for allowing for easy connection and removal of the waist band 110.

Figure 4:
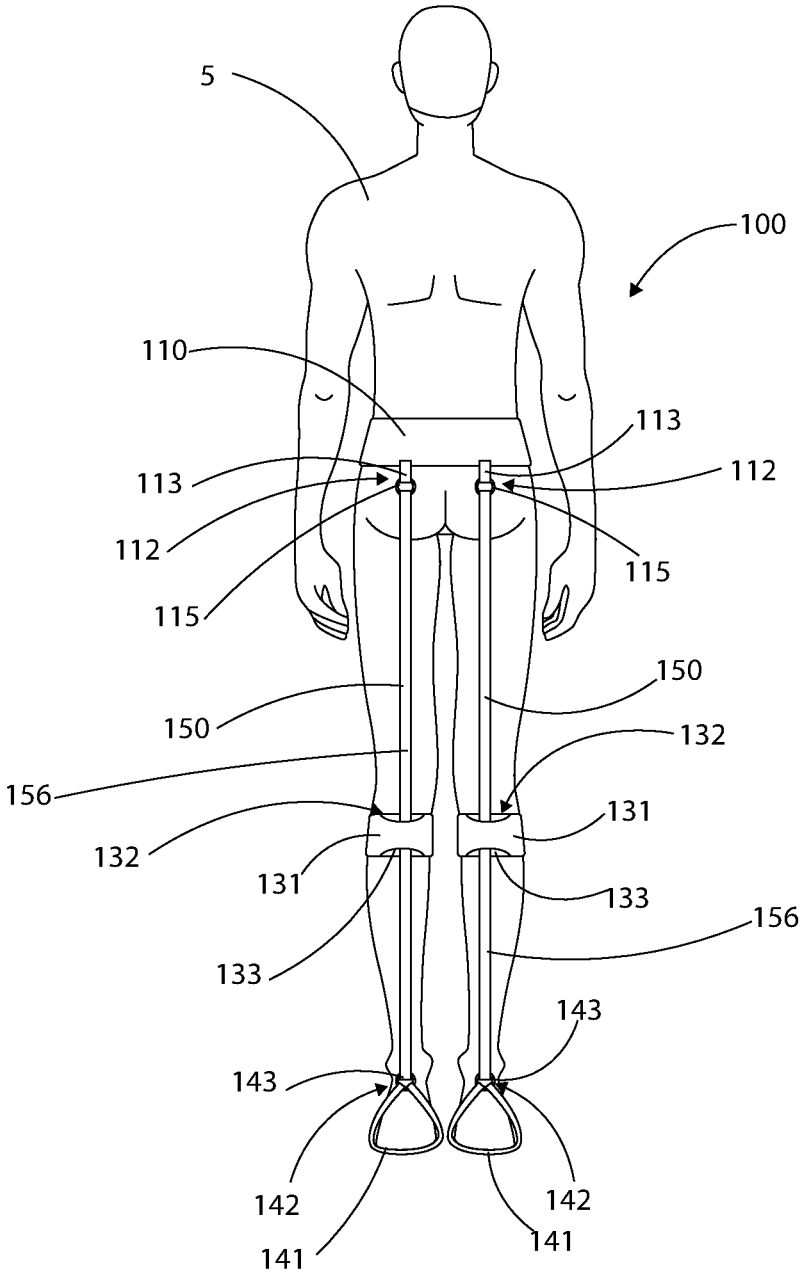
FIG. 4 is a rear view of the wearable resistance apparatus illustrating a waist band and a pair of leg resistance assemblies, each of the pair of leg resistance assemblies including a leg anchor, a foot anchor and a resistance band, according to an embodiment of the present disclosure.

The waist band 110 may include a pair of first band fasteners 112. As shown in FIG. 4, one of the first band fasteners 112 may be located on the waist band 110 such that it is disposed above a left leg of the wearer 5 (when the waist band 110 is attached thereto) and the other of the first band fasteners 112 may be located on the waist band 110 such that it is disposed above a right leg of the wearer 5.

As shown in FIGS. 1-6, the pair of leg resistance assemblies 120 may each be configured for wear about a respective leg of the wearer 5. For example, the pair of leg resistance assemblies 120 may include a left leg resistance assembly configured for wear about the left leg of the wearer 5, and a right leg resistance assembly configured for wear about the right leg of the wearer 5. Each of the leg resistance assemblies 120 may include identical features such that the leg resistance assemblies 120 may be easily swappable (i.e., a leg resistance assembly 120 worn on the left leg one day may be worn on the right leg day another day). As such, for the sake of clarity, both leg resistance assemblies 120 are discussed and shown in the figures with identical reference numbers. As shown, each leg resistance assembly 120 may include the leg anchor 130, the foot anchor 140, and the at least one resistance band 150.

Figure 5:
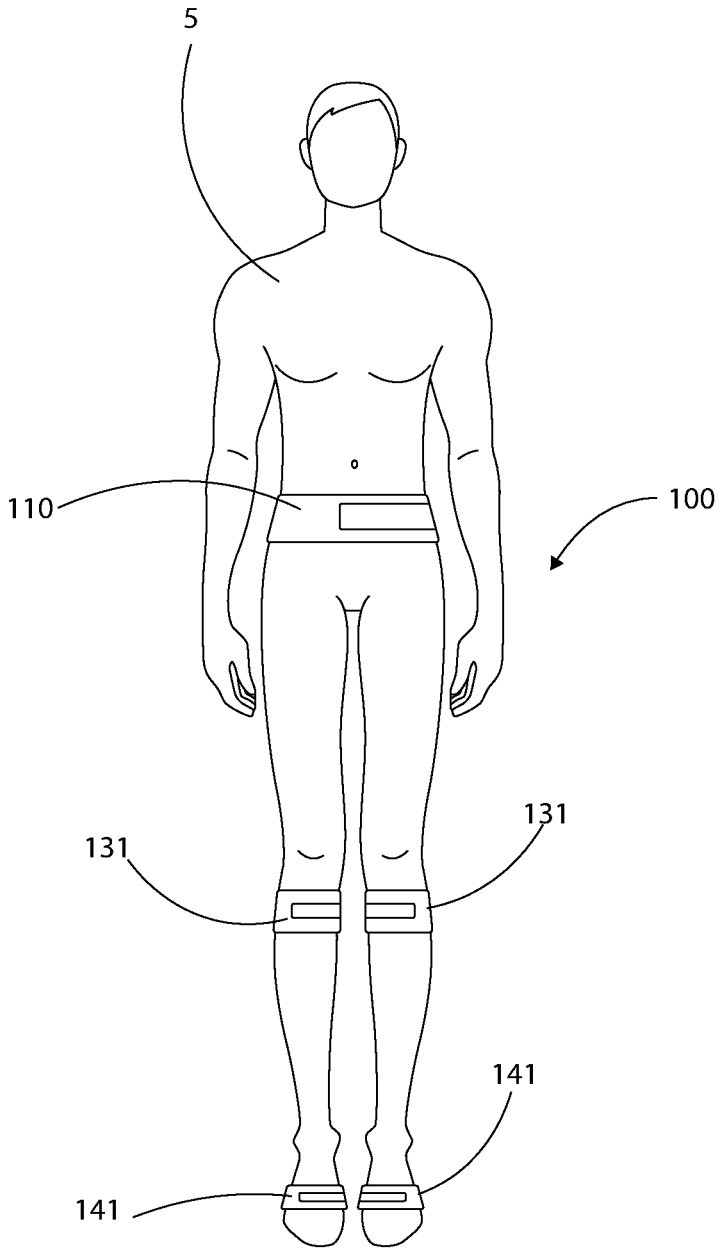
FIG. 5 is a front view of the wearable resistance apparatus of FIG. 4, according to an embodiment of the present disclosure.
Figure 6:
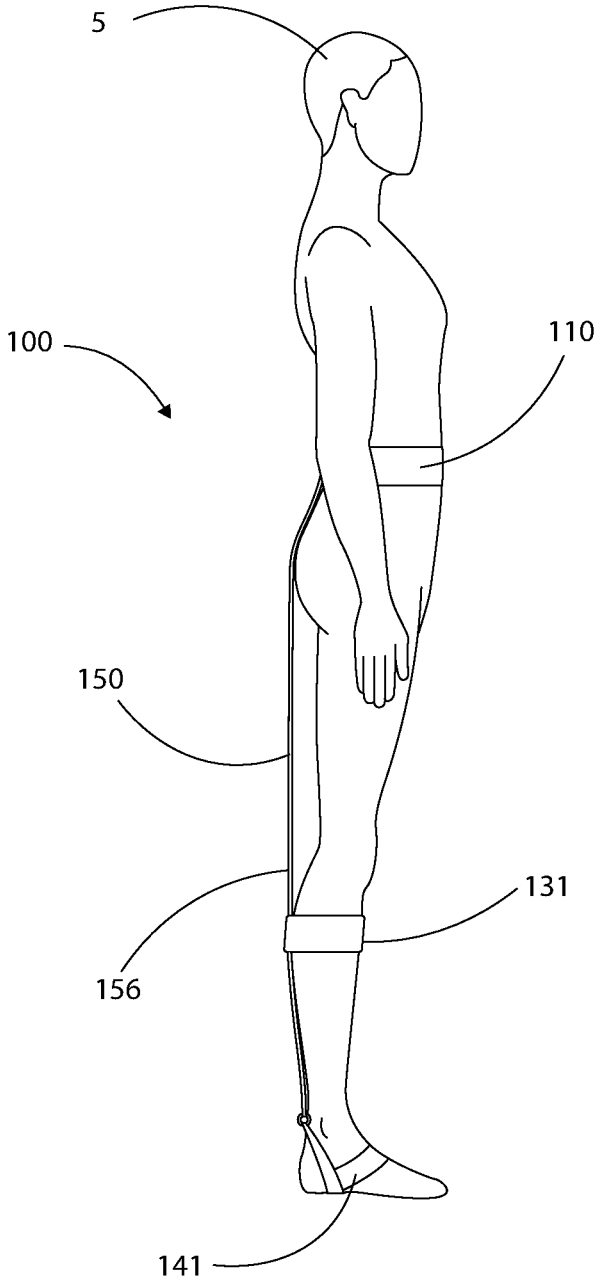
FIG. 6 is a side view of the wearable resistance apparatus of FIG. 4, according to an embodiment of the present disclosure.

As shown, the leg anchor 130 may be configured to attach about a knee area of the wearer 5. For example, as shown in FIGS. 4-6, the leg anchor 130 may attach about an under knee area. However, it should be appreciated that the leg anchor 130 is not limited to this location; for instance, the leg anchor 130 may attach about an upper knee area, over the knee, etc. In some embodiments, as shown in FIGS. 2-6, the leg anchor 130 may include a leg band 131 configured to encircle the knee area of the wearer 5. In some examples, the leg band 131 may be a continuous loop. In other examples, the leg band 131 may be fastened via fasteners, such as hook and loop fastener. Preferably, the leg anchor 130 may also be made from a material having a strength ranging from medium to heavy. Further, in some embodiments, the leg anchor 130 may be resistant to flexing. As shown, the leg anchor 130 may include a second band fastener 132.

Further, the foot anchor 140 may be configured to attach about a foot area of the wearer 5. As shown, the foot anchor 140 may include a foot strap 141 configured to strap under a foot of the wearer 5. In some embodiments, the foot strap 141 may be a thin non-flexible band that runs under the foot of the wearer 5. As shown, the foot anchor 140 may include a third band fastener 142 attached at a top of the foot strap 141.

The at least one resistance band 150 may include a first end 152 opposite a second end 154 and a band length 156 therebetween. As shown, the first end 152 may be configured to attach to one of the first band fasteners and the second end 154 may be configured to attach about the third band fastener 142 such that a substantially mid-section of the band length 156 rests about the second band fastener 132, thereby securing the at least one resistance band 150 against the respective leg between the waist area and the foot area.

Preferably, the at least one resistance band 150 may be provided in a variety of resistance strengths. As such, the resistance bands 150 may be easily removable from the pair of leg resistance assembly 120 so as to enable the wearer 5 to utilize different strengths depending on desired tension level. For example, the wearable resistance assembly 100 may include a variety of resistance bands 150 ranging from low strength (for example a 5 lb weight equivalent) to high strength (for example a 50 lb weight equivalent). In some embodiments, the variety of resistance bands may be separated into categories: basic resistance bands and athletic resistance bands. The basic resistance bands may range from 1-5 in strength. For example, 1 may be a 5 lb weight equivalent and 5 may be a 30 lb weight equivalent. The athletic resistance bands may range from 1-15 in strength. Again, in some examples, the 1 may be a 5 lb weight equivalent; and the 15 may be a 50 lb weight equivalent. It should however be appreciated that these weight equivalents are provided as examples only and the resistance bands 150 are not limited to the weights discussed here.

Figure 2:
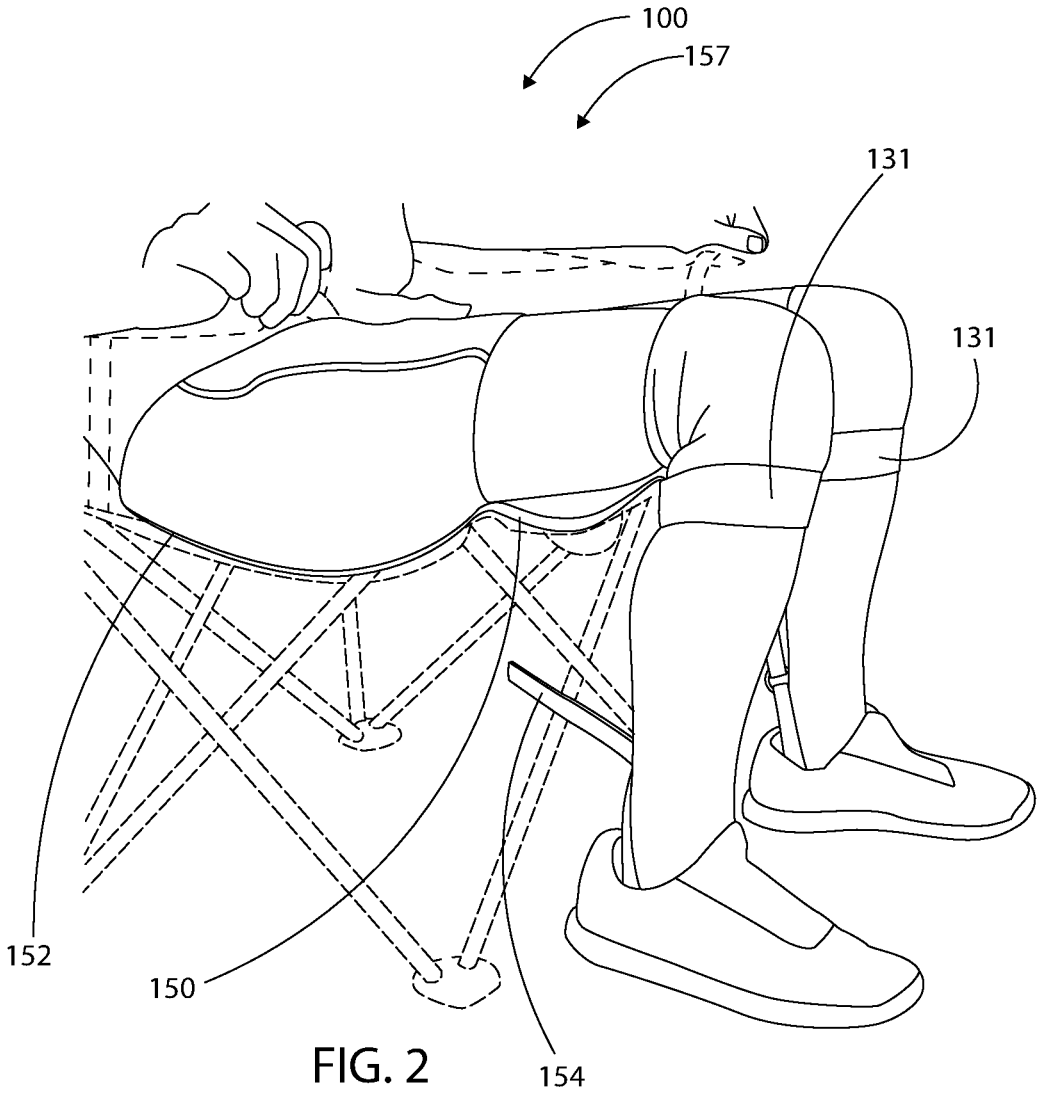
FIG. 2 is a perspective side view of the wearable resistance apparatus illustrating a resistance band in a neutral position, according to an embodiment of the present disclosure.

As shown in FIG. 2, the at least one resistance band 150 may be in a neutral position 157 when the wearer 5 is seated; meaning that the at least one resistance band 150 may provide zero resistance (or may provide minimal resistance) and thus no tension to legs of the wearer 5 when they are seated. Leg movement (for example, movement between extension and flexion) may then move the at least one resistance band 150 into a resistant position 159, thereby creating tension in at least one muscle between the waist area and the foot area of the wearer 5. Preferably, natural leg movements of the wearer 5 may place the at least one resistance band 150 into the resistant position 159.

Figure 3:
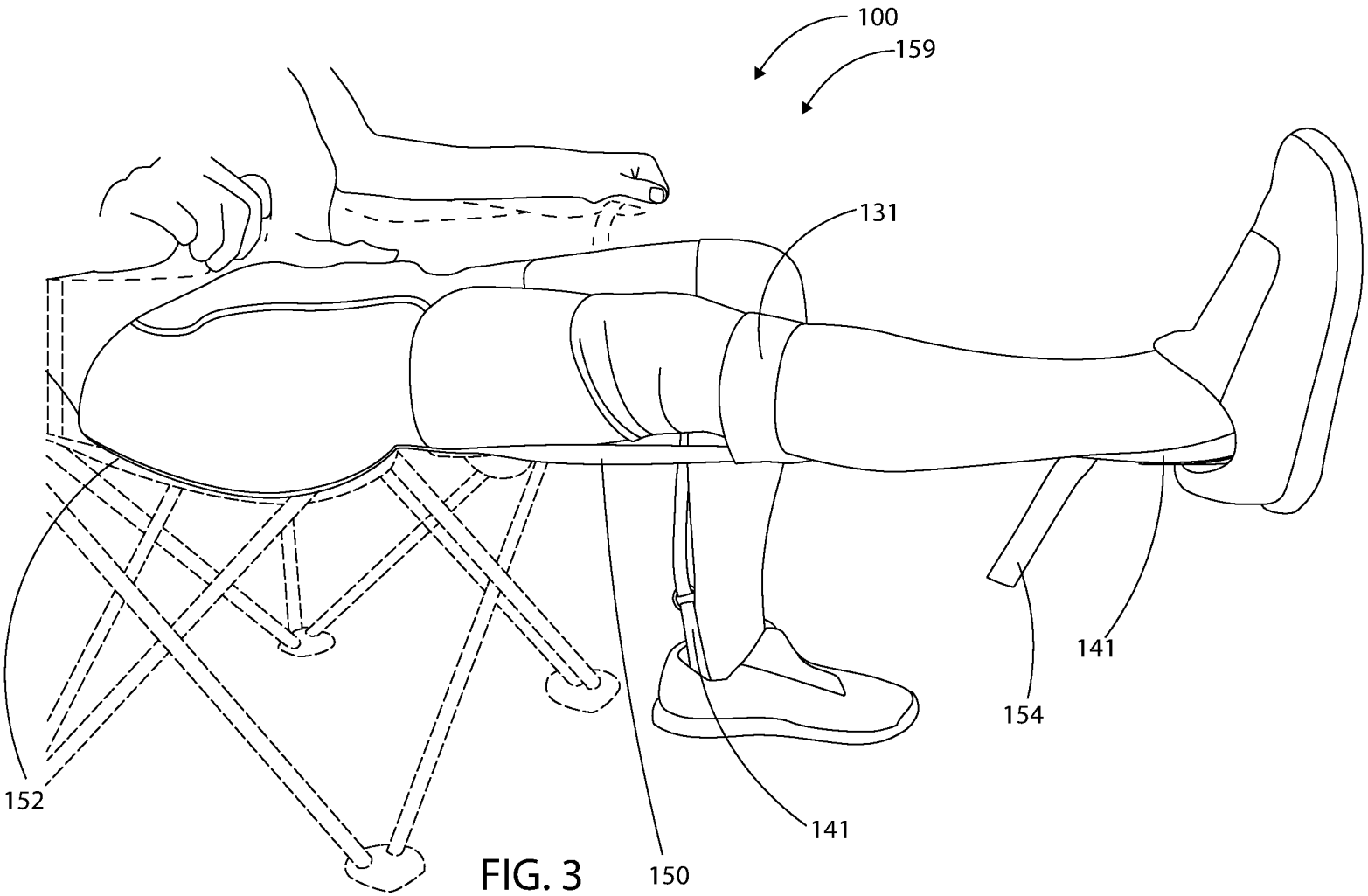
FIG. 3 is a perspective side view of the wearable resistance apparatus illustrating the resistance band in a resistant position, according to an embodiment of the present disclosure.

For example, when the wearer 5 is seated, their lower leg may be at a substantially 90 degree angle relative to their thigh (as shown in FIG. 2) and thus, when the lower leg is at the substantially 90 degree angle relative to the thigh, the at least one resistance band 150 may be in the neutral position 157. To move the at least one resistance band 150 into the resistant position 159 (and thereby provide exercise to the legs), the wearer 5 may move their lower leg to increase or decrease the substantially 90 degree angle relative to the thigh, as shown in FIG. 3. This may be achieved by moving the lower leg forward or backward. In another example, as shown in FIG. 1, the at least one resistance band 150 may be moved into the resistant position 159 when the wearer 5 either stands, cycles, runs, jogs, walks, or the like. Further, in some embodiments, the at least one resistance band 150 may assist the wearer 5 in lifting their legs when walking on an incline and may create resistance (move into the resistant position 159) when the wearer 5 is walking on a decline.

As shown in FIG. 4, in some embodiments, each first band fastener 112 may include a strap 113 encircling the waist band 110, and a first ring 115 attached to the strap 113. In this embodiment, the first end 152 of the at least one resistance band 150 may be configured to wrap about the first ring 115. In another example, the first end 152 of the at least one resistance band 150 may include a first band ring configured to connect with the first ring 115 (not illustrated). The third band fastener 142 may include a second ring 143 and the second end 154 of the at least one resistance band 150 may be configured to wrap about the second ring 143. As shown in FIGS. 1-4 and FIG. 6, the second ring 143 may be configured to rest about an ankle of the wearer 5. Similar to above, in another example, the second end 154 may include a second band ring configured to connect with the second ring 143 (not illustrated).

As shown particularly in FIG. 4, the second band fastener 132 may include an opening 133 in the leg anchor 130 (or leg band 131) and the second end 154 of the at least one resistance band 150 may be configured to thread through the opening 133. For example, the second end 154 may first be threaded through the opening 133 (after the first end 152 has been attached to one of the first band fasteners 112) and then attached to the third band fastener 142. The threading of the second end 154 through the opening 133 may keep the at least one resistance band 150 as close against the leg of the wearer 5 as possible.

As shown in FIGS. 1-6, the pair of first band fasteners 112 may be disposed at a rear section of the waist band 110, the second band fastener 132 may be disposed at a rear section of the leg anchor 130, and the third band fastener 142 may be disposed at a rear section of the foot anchor 140. As such, the at least one resistance band 150 may rest against a rear of the leg of the wearer 5. As such, the resistant position 159 may create tension in posterior body muscles of the wearer 5. For example, gluteal muscles, hamstring muscles, and/or calf muscles. Particularly, the wearable resistance apparatus 100 may be used for increasing strength in the gluteus maximus.

Figure 7:
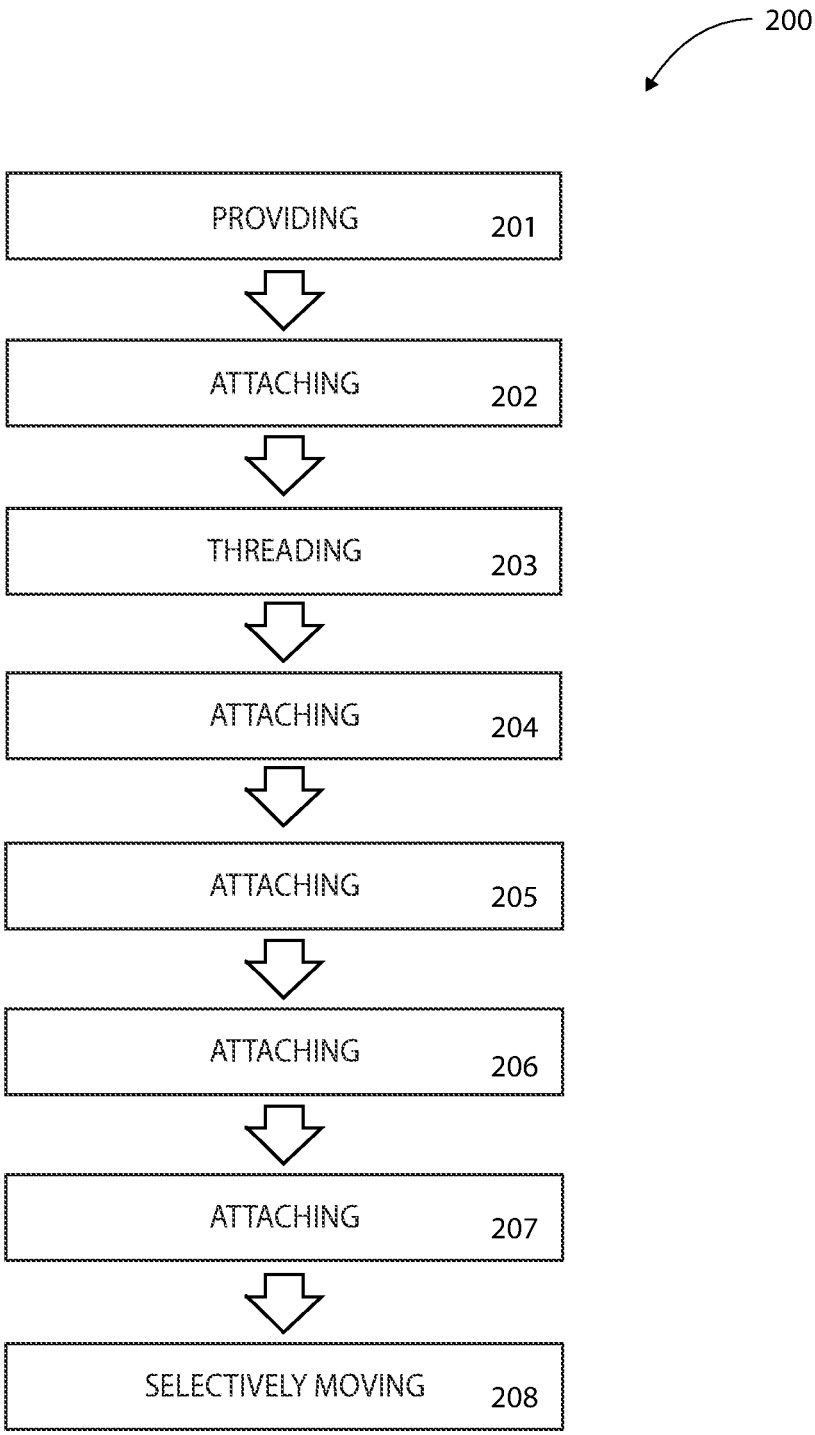
FIG. 7 is a flow diagram illustrating a method of using a wearable resistance assembly, according to an embodiment of the present disclosure.

Referring now to FIG. 7 showing a flow diagram illustrating a method 200 of using a wearable resistance apparatus, according to an embodiment of the present disclosure. In particular, the method 200 may include one or more components or features of the wearable resistance assembly 100 as described above. As illustrated, the method 200 may include the steps of: step 201, providing the wearable resistance assembly as above; step 202, attaching the first end of the at least one resistance band of each leg resistance assembly to the pair of first band fasteners; step 203, threading the second end of the at least one resistance band of each leg resistance assembly through the second band fastener such that substantially the mid-section of the band length rests about the second band fastener; step 204, attaching the second end of the at least one resistance band of each leg resistance assembly about the third band fastener; step 205, attaching the waist band to the wearer such that the waist band encircles a waist area of the wearer; step 206, attaching the leg anchor of each leg resistance assembly to each knee area of the wearer; step 207, attaching the foot anchor of each leg resistance assembly to each foot area of the wearer; and step 208, selectively moving each leg of the wearer, thereby moving the at least one resistance band of each respective leg resistance assembly into the resistant position and creating tension in at least one muscle between the waist area and the foot area of each leg.

As above, the at least one resistance band may be moved into the resistant position when an angle between the lower leg of the wearer and the thigh of the wearer is either increased or decreased from substantially 90 degrees; and/or when the wearer performs one of standing, cycling, running, jogging and walking. Further, as above, the pair of first band fasteners may be disposed at the rear section of the waist band, the second band fastener may be disposed at the rear section of the leg anchor and the third band fastener may be disposed at the rear section of the foot anchor and as such, the resistant position may create the tension in at least one of the gluteal muscles, hamstring muscles, and/or calf muscles of the wearer.

It should be noted that certain steps may be optional and may not be implemented in all cases. Optional steps of method 200 are illustrated using dotted lines in FIG. 7 so as to distinguish them from the other steps of method 200. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a wearable resistance apparatus are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A wearable resistance apparatus comprising:

a waist band configured to encircle a waist area of a wearer, the waist band including a right waist band fastener and a left waist band fastener;

a right foot anchor configured to attach about the right foot area of the wearer, the right foot anchor including a right foot band fastener;

a right leg resistance assembly configured for wear about the right leg of the wearer, the right leg resistance assembly having a right leg anchor configured to attach about a right knee area of the wearer, the right leg anchor including a right knee band fastener;

a right resistance band including a right first end opposite a right second end and a right band length therebetween, the right first end configured to attach to the right waist band fastener and the right second end configured to attach about the right foot band fastener such that a mid-section of the right band length rests about the right knee band fastener allowing the right knee band fastener to secure the right resistance band against the right leg between the waist area and the right foot area;

a left foot anchor configured to attach about the left foot area of the wearer, the left foot anchor including a left foot band fastener;

a left leg resistance assembly configured for wear about the left leg of the wearer, the left leg resistance assembly having a left leg anchor configured to attach about a left knee area of the wearer, the left leg anchor including a left knee band fastener;

a left resistance band including a left first end opposite a left second end and a left band length therebetween, the left first end configured to attach to the left waist band fastener and the left second end configured to attach about the left foot band fastener such that a mid-section of the left band length rests about the left knee band fastener allowing the left knee band fastener to secure the left resistance band against the left leg between the waist area and the left foot area; and wherein the right resistance band and the left resistance band are in a neutral position when the wearer is seated and provides zero to minimal resistance to the wearer in the neutral position;

wherein leg movement moves the right resistance band and the left resistance band into a resistant position, thereby creating tension in at least one muscle between the waist area and the right foot area and left foot area of the wearer; and wherein one or both of the right and left resistance bands are configured to be the only connection or engagement between the waist band, the respective right and left foot anchors and the respective right and left leg anchors.

2. The wearable resistance apparatus of claim 1, wherein each of the right and left resistance bands are moved into the resistant position when an angle between a lower leg of the wearer and a thigh of the wearer is one of increased and decreased from 90 degrees.

3. The wearable resistance apparatus of claim 2, wherein each of the right and left resistance bands are moved into the resistant position when the wearer performs one of standing, cycling, running, jogging and walking.

4. The wearable resistance apparatus of claim 3, wherein each of the right and left waist band fasteners are disposed at a rear section of the waist band, wherein the second band fastener is disposed at a rear section of the leg anchor, and wherein the third band fastener is disposed at a rear section of the foot anchor.

5. The wearable resistance apparatus of claim 4, wherein the resistant position creates tension in at least one of gluteal muscles, hamstring muscles and calf muscles.

6. The wearable resistance apparatus of claim 1, wherein the right waist band fastener and a left waist band fastener each includes a strap attached to the waist band and a first ring attached to the strap, and wherein the first end of each of the right and left resistance bands is configured to attach to one of the first rings.

7. The wearable resistance apparatus of claim 1, wherein each of the right and left foot anchors includes a foot strap configured to strap under a foot of the wearer.

8. A wearable resistance apparatus comprising:

a waist band configured to encircle a waist area of a wearer, the waist band including a right waist band fastener and a left waist band fastener, the right waist band fastener including a right waist strap attached to the waist band and a right waist band ring attached to the right waist strap, the right waist band fastener disposed in line with a right leg of the wearer when the waist band is attached thereto, the left waist band fastener including a left waist strap attached to the waist band and a left waist band ring attached to the left waist strap, the left waist band fastener disposed in line with a left leg of the wearer when the waist band is attached thereto;

a right leg resistance assembly having a right leg anchor configured to attach about a right knee area of the wearer, the right leg anchor including a right knee band configured to encircle the knee area of the wearer and a right knee band fastener, the right knee band fastener defined by a right opening in the right leg anchor, a right foot anchor configured to attach about a right foot area of the wearer, the right foot anchor including a right foot strap configured to strap under a right foot of the wearer and a right foot band fastener, the right foot band fastener including a right foot ring;

a left leg resistance assembly having a left leg anchor configured to attach about a left knee area of the wearer, the right leg anchor including a left knee band configured to encircle the knee area of the wearer and a left knee band fastener, the left knee band fastener defined by a left opening in the left leg anchor, a left foot anchor configured to attach about a left foot area of the wearer, the left foot anchor including a left foot strap configured to strap under a left foot of the wearer and a left foot band fastener, the left foot band fastener including a left foot ring;

a right resistance band including a right first end opposite a right second end and a right band length therebetween, the right first end configured to attach to the right waist band fastener and the right second end configured to attach about the right foot band fastener, the right resistance band configured to thread through the right opening such that a mid-section of the right band length rests about the right knee band fastener, thereby securing the right resistance band between the waist area and the right foot area; and a left resistance band including a left first end opposite a left second end and a left band length therebetween, the left first end configured to attach to the left waist band fastener and the left second end configured to attach about the left foot band fastener, the left resistance band configured to thread through the left opening such that a mid-section of the left band length rests about the left knee band fastener, thereby securing the left resistance band between the waist area and the left foot area, wherein each of the right and left resistance bands are in a neutral position when the wearer is seated and provides zero to minimal resistance to the wearer in the neutral position;

wherein movement of the leg moves the resistance band into a resistant position, thereby creating tension in at least one muscle between the waist area and the foot area of the wearer; and wherein one or both of the right and left resistance bands are configured to be the only connection or engagement between the waist band, the respective right and left foot anchors and the respective right and left leg anchors.

9. The wearable resistance apparatus of claim 8, wherein each of the right and left resistance bands are moved into the resistant position when an angle between a lower leg of the wearer and a thigh of the wearer is one of increased and decreased from substantially 90 degrees.

10. The wearable resistance apparatus of claim 9, wherein each of the right and left resistance bands are moved into the resistant position when the wearer performs one of standing, cycling, running, jogging and walking.

11. The wearable resistance apparatus of claim 10, wherein each of the right and left waist band fasteners are disposed at a rear of the waist band, wherein the second band fastener is disposed at a rear of the leg anchor, and wherein the third band fastener is disposed at a rear of the foot anchor.

12. The wearable resistance apparatus of claim 11, wherein the resistant position creates tension in at least one of gluteal muscles, hamstring muscles and calf muscles.

13. A method of using a wearable resistance apparatus, the method comprising the steps of:

providing the wearable resistance apparatus including:

a waist band configured to encircle a waist area of a wearer, the waist band including a right waist band fastener and a left waist band fastener;

a right leg resistance assembly configured for wear about a right leg of the wearer, the right leg resistance assembly including:

a right foot anchor configured to attach about the right foot area of the wearer, the right foot anchor including a right foot band fastener, a right leg anchor configured to attach about a right knee area of the wearer, the right leg anchor including a right knee band fastener, a left leg resistance assembly configured for wear about a left leg of the wearer, the left leg resistance assembly including:

a left foot anchor configured to attach about the left foot area of the wearer, the left foot anchor including a left foot band fastener, a left leg anchor configured to attach about a left knee area of the wearer, the left leg anchor including a left knee band fastener;

providing a right resistance band including a right first end opposite a right second end and a right band length therebetween, the right first end configured to attach to the right waist band fastener and the right second end configured to attach about the right foot band fastener, the right resistance band configured to thread through the right opening such that a mid-section of the right band length rests about the right knee band fastener, thereby securing the right resistance band between the waist area and the right foot area;

providing a left resistance band including a left first end opposite a left second end and a left band length therebetween, the left first end configured to attach to the left waist band fastener and the left second end configured to attach about the left foot band fastener, the left resistance band configured to thread through the left opening such that a mid-section of the left band length rests about the left knee band fastener, thereby securing the left resistance band between the waist area and the left foot area, wherein each of the right and left resistance bands are in a neutral position when the wearer is seated and provides zero to minimal resistance to the wearer in the neutral position, and wherein movement of the leg moves the resistance band into a resistant position, thereby creating tension in at least one muscle between the waist area and the foot area of the wearer;

attaching the first end of the right resistance band to the right waist band fastener;

attaching the first end of the left resistance band to the left waist band fastener;

threading the right resistance band configured to thread through the right opening such that a mid-section of the right band length rests about the right knee band fastener, thereby securing the right resistance band between the waist area and the right foot area;

threading the left resistance band configured to thread through the left opening such that a mid-section of the left band length rests about the left knee band fastener, thereby securing the left resistance band between the waist area and the left foot area;

attaching the right second end to the right foot band fastener;

attaching the left second end to the left foot band fastener;

attaching the waist band to the wearer such that the waist band encircles a waist area of the wearer; and wherein one or both of the right and left resistance bands are configured to be the only connection or engagement between the waist band, the respective right and left foot anchors and the respective right and left leg anchors; and selectively moving the right and left legs of the wearer, thereby moving the right and left resistance bands into the resistant position and creating tension in at least one muscle between the waist area and the foot area of the leg.

14. The method of claim 13, wherein each of the right and left resistance bands is moved into the resistant position when an angle between a lower leg of the wearer and a thigh of the wearer is one of increased and decreased from 90 degrees.

15. The method of claim 14, wherein each of the right and left resistance bands is moved into the resistant position when the wearer performs one of standing, cycling, running, jogging and walking.

16. The method of claim 15, wherein the right and left waist band fasteners are disposed at a rear section of the waist band, wherein the right and left knee band fastener are is disposed at a rear section of the respective right and left leg anchors, wherein the right and left foot band fasteners are is disposed at a rear section of the respective right and left foot anchors, and wherein the resistant position creates tension in at least one of gluteal muscles, hamstring muscles and calf muscles.

* * * * *